US005737772A

United States Patent [19]

Dicker et al.

[11] Patent Number: 5,737,772

[45] Date of Patent: Apr. 14, 1998

[54] METHOD OF MANUFACTURING AEROBIC EXERCISE GARMENT

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 802,972

[22] Filed: Feb. 20, 1997

[51] Int. Cl.[6] ..... A41B 1/00; A41D 13/02

[52] U.S. Cl. ..... 2/69; 2/115; 2/79; 482/105

[58] Field of Search ..... 2/69, 79, 70, 227, 2/228, 238, 170, 108, 115, 102; 482/105, 121, 124, 131, 74; 450/104

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 3,411,500 | 11/1968 | Gatts . | |
| 3,559,654 | 2/1971 | Pope . | |
| 3,759,510 | 9/1973 | Jackson . | |
| 4,065,814 | 1/1978 | Fox . | |
| 4,220,299 | 9/1980 | Motter . | |
| 4,325,379 | 4/1982 | Ozbey . | |
| 4,384,369 | 5/1983 | Prince . | |
| 4,670,913 | 6/1987 | Morell . | |
| 4,698,847 | 10/1987 | Yoshihara . | |
| 4,910,802 | 3/1990 | Malloy . | |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz . | |
| 5,060,315 | 10/1991 | Ewing . | |
| 5,062,642 | 11/1991 | Berry . | |
| 5,109,546 | 5/1992 | Dicker | 2/70 |
| 5,141,223 | 8/1992 | Block . | |
| 5,176,600 | 1/1993 | Wilkinson . | |
| 5,186,701 | 2/1993 | Wilkinson . | |
| 5,201,074 | 4/1993 | Dicker | 2/70 |
| 5,203,754 | 4/1993 | MacLean . | |
| 5,256,119 | 10/1993 | Tudor . | |
| 5,263,916 | 11/1993 | Bobich . | |
| 5,267,928 | 12/1993 | Barile . | |
| 5,282,277 | 2/1994 | Onozawa . | |
| 5,306,222 | 4/1994 | Wilkinson | 482/124 |
| 5,308,305 | 5/1994 | Romney . | |
| 5,336,139 | 8/1994 | Miller . | |
| 5,357,637 | 10/1994 | Moore . | |
| 5,367,708 | 11/1994 | Fujimoto | 2/69 |
| 5,372,565 | 12/1994 | Burdenko . | |
| 5,375,610 | 12/1994 | LaCourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,570,472 | 11/1996 | Dicker | 2/69 |

*Primary Examiner*—Gloria F. Hale
*Attorney, Agent, or Firm*—Connolly & Hutz

[57] ABSTRACT

An aerobic exercise garment includes a body section and limb sections. The garment includes a base fabric which incorporates elastic resistance band material having a direction of stretch. The elastic resistance band material is formed with a minimal number of pieces and is incorporated in the garment by securing the pieces together at locations which do not interfere with the direction of resistance.

23 Claims, 3 Drawing Sheets

METHOD OF MANUFACTURING AEROBIC EXERCISE GARMENT

BACKGROUND OF THE INVENTION

Various garments have been suggested which include elastic elements to provide a resistance to an activity which would require swinging or bending of the arms or legs or the bending of various body parts. Examples of such garments are found in U.S. Pat. Nos. 5,109,546, 5,176,600, 5,186,701, 5,201,074, 5,306,222 and 5,570,472.

SUMMARY OF THE INVENTION

An object of this invention is to provide manufacturing techniques which could be used for readily making aerobic resistance garments which include elastic bands as part of the garment.

A further object of this invention is to provide an exercise garment which is made by incorporating elastic resistance panels having a direction of stretch. The resistance panels are secured to the remainder of the garment in such a way that the securement does not interfere with the stretch.

In accordance with this invention patterns are made from the garment sections. Portions of the sections would have different elastic characteristics so as to provide the resistance bands which require a greater resistance force to be overcome by the user while wearing the garment. The other sections of the garment are secured together to form a basic unit and the resistance bands are then incorporated into the unit.

The garment made by this invention preferably includes a pants section having a body portion and leg portions and having suspender portions. A single elastic band extends from one side of the suspender portion completely down the body and leg portions on the front and rear of the pants so as to minimize the number of pieces add to avoid interference with the performance of the elastic bands.

DETAILED DESCRIPTION

Figure 1:
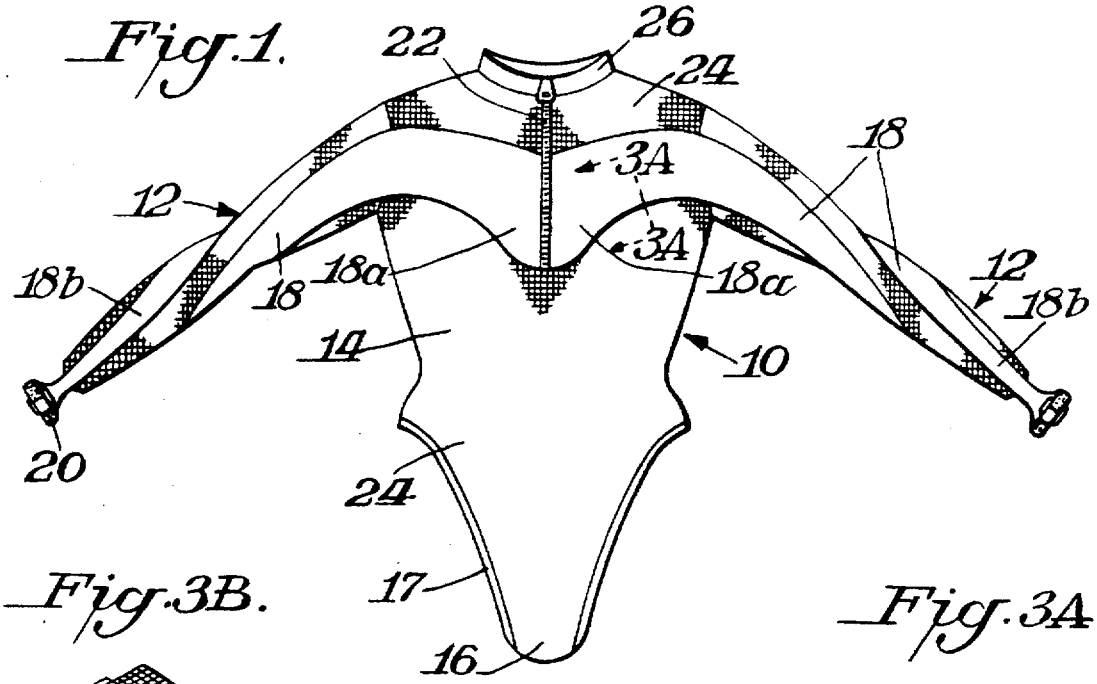
FIG. 1 is a front elevational view of one portion of an aerobic resistance garment made in accordance with this invention.

The present invention relates to manufacturing techniques for incorporating elastic resistance bands into aerobic resistance garments. Reference is made to U.S. Pat. Nos. 5,109,546, 5,176,600, 5,186,701, 5,201,074, 5,306,222 and 5,570,472, all of the details of which are incorporated herein with reference thereto. Such patents exemplify the general types of garments to which the manufacturing techniques may be applied. Other more specific forms will be described in detail hereafter.

In general, the aerobic resistance garment would be made from two different types of materials having different elastic characteristics. It is essential that one of the materials which functions as the elastic resistance elements or bands have a greater resistance force which must be overcome by the user while wearing the garment. The other material could have some degree of elasticity and could be made of the types of materials noted in the aforementioned patents. The base material for the garment would be selected so as to provide comfort to the user. Such material could be a stretch material having four-way or two-way stretch, a preferably using a LYCRA spandex yarn. Other examples are DuPont's TACTEL and SUPPLEX. The elastic resistance material would have stretch in at least one direction and would require a greater force by the user to cause the stretch thereby enhancing the aerobic quality of the material. Reference is had to the aforenoted patents for examples of such materials for elastic resistance bands. A suitable material is a raschel knit containing LYCRA spandex.

The garment would include at pre-selected locations the elastic resistance bands. Generally, such bands have anchor structure in order to function as an aerobic garment. For example, where used in the shirt portion of the garment the anchor structure might be at the ends of the arms, such as at the hands or wrists. Where used in the pants portion of the garment the anchor structure might be at the legs or feet and might also be at the shoulders. Other locations of anchor structure might also be used with the practice of this invention. For example, a pants portion may terminate at the waist and anchor structure could be provided at the waist. A pants portion might also terminate in the general area of the knees and the anchor structure could be provided at, above or below the knees. With regard to the shirt portion the elastic band could extend from arm to arm with the anchor structure at each arm. Alternatively, the elastic band could extend from one arm to a further portion of the garment such as on the torso, neck or shoulder area and be provided with anchor structure at that area.

In general, the aerobic garment would be made by first designing the garment and determining the body dimensions. Next, the fabric would be selected and patterns would be made. Preferably the first sample would be cut and sewn and then fitted. After this testing any errors in the patterns would be corrected. A second sample would then be cut, sewn and fitted and corrections made for fit, function and patterns. The patterns would be graded and markers made. Specification sheets would be set up and sewing sheets would be created. Cutting tickets would be written and the final garments would be cut and sewn.

In general, the basic fabric would have its sections sewn together to form a base unit. The elastic aerobic bands would then be incorporated into the basic garment by being sewn at the appropriate locations to form a final garment section. A significant feature of the invention is that the elastic bands are designed so as to minimize the number of pieces required and to avoid seams across the direction of stretch which would otherwise interfere with the performance of the elastic resistance bands. A characteristic of such elastic resistance bands would be the high modulus required to return the bands when stretched. Thus, a physical exertion is required to stretch the bands and the muscles work to hold or restrain the bands when the bands attempt to return to their original unstretched size.

Figure 2:
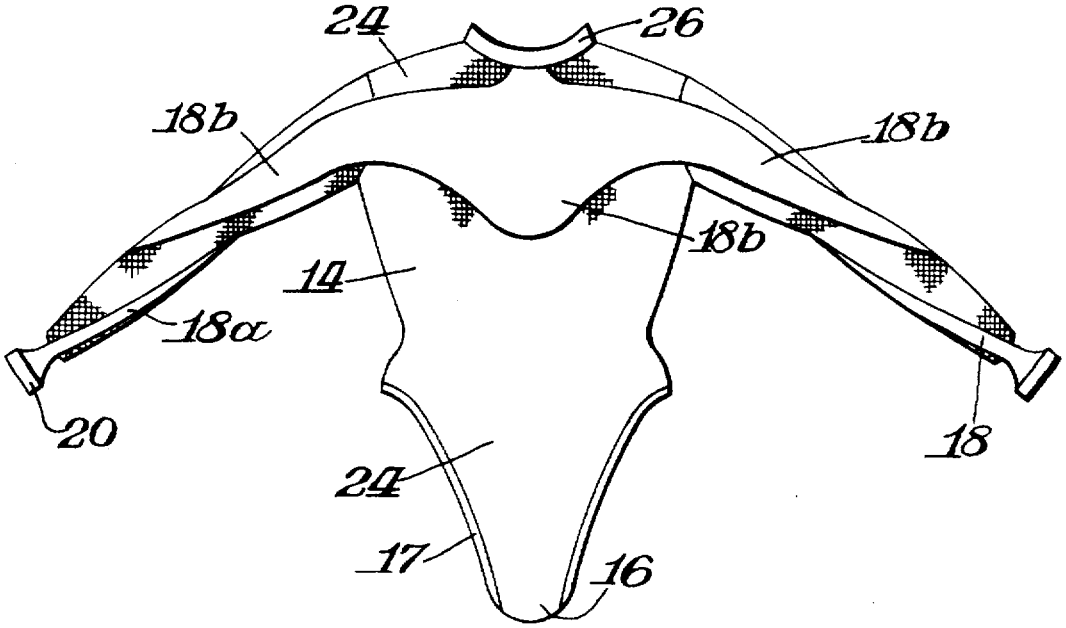
FIG. 2 is a rear elevational view of the garment shown in FIG. 1.

FIGS. 1–2 illustrate a shirt portion 10 of a final form of an elastic garment. In the form illustrated therein the shirt portion 10 is a body suit similar to leotards. Thus, shirt portion 10 would include a pair of arms 12,12 a body section 14 and a crotch area 16 with leg openings 17. An elastic resistance band 18 is provided on both the front and rear portions of the garment and with each band 18*a*,18*b* extending from arm to arm and being connected to a loop 20 into which the hand of the user would be inserted or which could be a wrist loop to anchor the elastic band 18. As shown in FIG. 1 the front the band 18 may be interrupted by a zipper 22 which is provided to permit the garment to be easily put on or removed. Where a zipper or other attaching elements are used the full benefits of the elastic band may not be obtained since the location of the zipper is across the direction of stretch of the elastic band. An intent of the invention is to minimize any interference, such as by seams, with the performance of the elastic resistance bands.

Figure 3B:
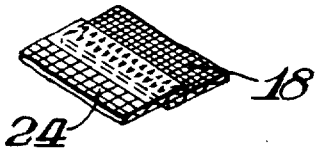
FIGS. 3A and 3B are a perspective views showing the elastic band stitched to the base fabric.
Figure 3A:
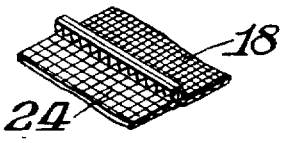

FIG. 3 shows how the elastic resistance band material 18 is stitched to the base fabric 24. The stitching occurs at locations which do not extend across the direction of stretch of the elastic bands. This is a preferred characteristic of the invention to enhance the performance of the garment. As illustrated in FIGS. 1–2 rear band 18*b* rotates around the front of the wrist. Front resistance band 18*a* goes down the arms and terminates underneath the wrists.

Figure 4:
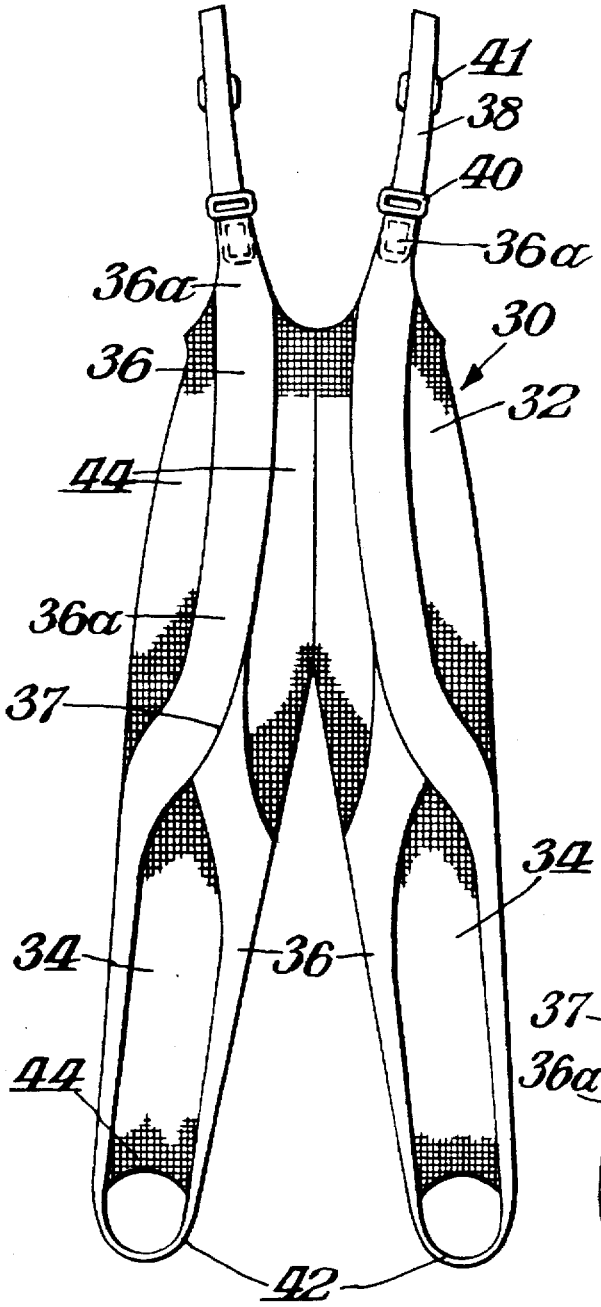
FIG. 4 is a front elevational view of a pants section for an aerobic resistance garment made in accordance with this invention.
Figure 5:
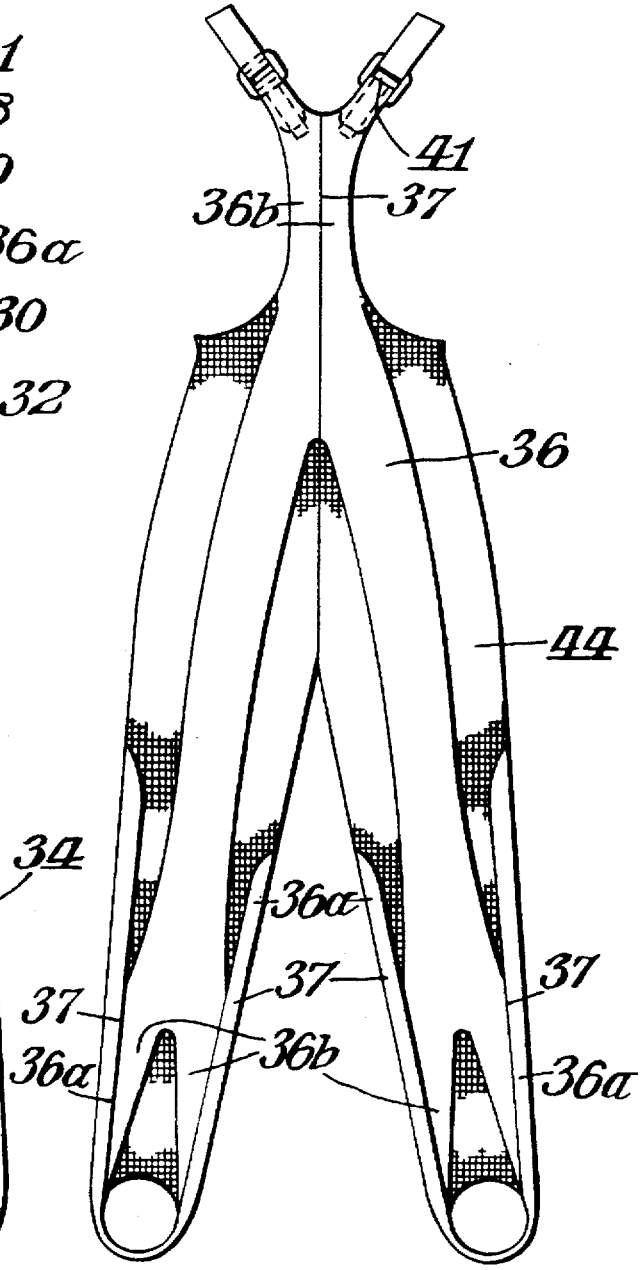
FIG. 5 is a rear elevational view of the pants section shown in FIG. 1.

FIGS. 4–5 illustrate a pants section 30 for the aerobic exercise garment. As shown therein the pants section 30 would have a body portion 32 and leg portions 34. Elastic resistance bands 36 are provided on the leg portions and extend upwardly from the body portion 32 to form suspenders 38. The base fabric is indicated by the reference numeral 44. As later described buckles or other adjusting devices 40 would also be provided to permit the proper fit to be attained by the user. As illustrated in FIGS. 4–5 the elastic resistance bands 36 also form loops or stirrups 42 which would function as anchor elements at one end of the pants with the suspenders being placed over the shoulders functioning as anchor elements at the other end of the pants.

Figure 6:
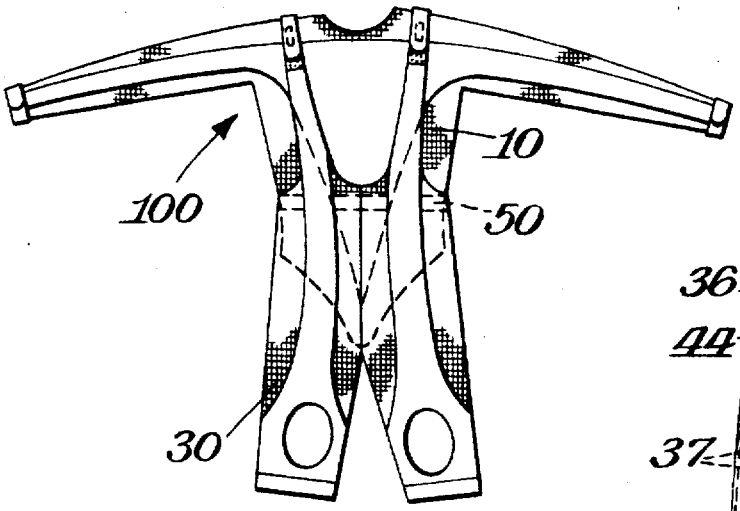
FIG. 6 is a front elevational view showing both garments of FIGS. 1–2 and FIGS. 4–5 assembled into a combined product.

If desired each of the shirt portion 10 and the pants portion 30 may be worn separately to function as an individual aerobic exercise garment. Alternatively, as shown in FIG. 6 the shirt portion 10 and pants portion 30 may be worn together to form a combined exercise garment 100. When worn together the shirt portion 10 and pants 30 may be secured together by any suitable attaching structure 50 such as detachable elements including, but not limited to, clips, buttons, VELCRO® or maybe permanently attached by stitching or other suitable means.

As shown in FIG. 1 the elastic resistance bands 18 on the front of the shirt 10 includes two separate elastic bands 18*a*,18*a* which extend from the central portion of the body 14 completely to and beyond the ends of the arms 12. The two elastic bands 18*a*,18*a* are secured together by zipper 22. As shown in FIG. 2 the elastic resistance band on the back of the shirt is a single elastic band 18*b* which extends from arm to arm completely across the body portion 14 of the shirt. Each elastic strip or band 18*a*,18*b* is connected to a band of cushioning material such as neoprene which forms a closed loop by any suitable detachable fasteners such as buckles, clips or VELCRO® so as to provide anchor structure for the elastic bands. If desired the loop 20 could be a permanently closed loop made of elastic material to function as a compression band which would accommodate various sizes of users.

As shown in FIG. 4 pants 30 includes on its front side a first set of elastic bands 36*a*,36*a* which extend from the suspenders and down the pants to a location slightly above the knee. The elastic resistance band 36*a* then shifts its direction toward the outside and continues down the leg forming the loop 42 and then continues up the leg where it terminates and is secured to itself by the seam 37. As can be appreciated the seam 37 is at a location which is not across and thus does not interfere with the direction of stretch of the elastic resistance band 36*a*. As should also be appreciated this arrangement permits the use of a single piece of elastic resistance band fabric to be used on the front side of pants 30 for each leg 34.

FIG. 4 illustrates the back side of the pants 30. As shown therein a second pair of elastic bands 36*b*,36*b* is provided which extends from the suspenders and runs the length of the body portion to a location below the knee where each band bifurcates and then is joined to a corresponding portion of the front band 36*a*.

The bifurcated portions of elastic band 36*b* are sewn to front band 36*a* by stitching 37. The individual elastic bands 36*b*,36*b* are sewn together in the suspenders portion of the pants by stitching 37. Thus, all of the stitching of the elastic band is at a location which does not interfere with the direction of resistance of the elastic bands.

The extended portions of bands 36*a* and 36*b* are connected together to form the suspenders 38. If desired, each band 36*b*,36*b* may be permanently sewn or connected to a loop member 41 as shown in FIG. 5, by extending around the member 41 and being sewn to itself. The opposite bands 36*a*,36*a* may extend through a double slotted buckle 40 and then through the loop member 41. The end of each band 36*a*,36*a* may then be sewn to itself thereby providing a loop structure between buckle 40 and loop member 41. This provides adjustability in the effective length of the suspenders 38. Padding may be provided on the underside of the portion of bands 36*a*,36*a* which comprise their part of the suspenders 38.

In making the shirt portion 10 the front and back crotches are sewn together with the crotch liner extending wrong side up on the back. Next, the side seams of the body are sewn together to form a basic unit. The crotch liner is flipped over to the front. Elastic is stitched to the legs, turned and cover-stitched and the underarms are sewn to the body portion. The upper arms are sewn to the shoulders. The front elastic bands 18*a* are sewn to the shoulders/upper arms and the back elastic band 18*b* is also sewn to the shoulders/upper arms.

In making the shirt portion 10 the process continues with the running of a binding or sewing of a collar 26 to the neck. The collar could also include appropriate labels. Zipper 22 is sewn to the center front joining the patterns for the fabric 24 and the elastic hand 18. The zipper is topstitched. The front and back bands 18 are then sewn to the body and lower arms. Seam allowance is turned at the sides of the hands (i.e. the bottom of the arm) and coverstitched. The inner edge of the hands are stitched together. Next, neoprene bands or strips are coverstitched which would form the loops 20. VELCRO® hook fabric is sewn to the top of the neoprene bands with the neoprene bands sewn at the bottom edges of the hands or ends of the sleeves and with the VELCRO® hook located at the outer edge of the hands on the neoprene (or other suitable material) bands, so that the loop 20 could be adjustably formed in accordance with the proper circumferential dimension of the proper user.

FIGS. 4–5 are now referred to with regard to the making of the pants section 30. The center back legs fabric 44 and back bands fabric 36 would be sewn together. Next, the back bands 36b would be sewn together from above the crotch to the center back. The left and right sides would be sewn to the back bands 36b. The center front rises are sewn together and the upper front legs are sewn to the upper back legs. Then, the top of the back ankle inserts are sewn between notches to the bottom of the back bands 36b. The inner edge of the front ankle inserts are sewn to the short edge of the short curved section of the front bands 36a. The upper edge of the short curved section of the front band 36a is sewn to the front inner thigh, inner edge of back band 36b and back ankle insert. Then the inner edge of the front bands is sewn from the waist to the foot picking up the other end of the bands 36a and outer edge of the front ankle inserts. The outer edge of the bands 36a is sewn to side panels picking up the lower edges of the back bands and outer edge of the back ankle inserts. Then, the openings of stirrup 42 are coverstitched. A ⅜ inch elastic strip is sewn to the outer edge of the back band 36b along the sides to the front notch above the waist then a ⅜ inch rubber elastic strip is sewn to the center back edges (inner edges of Y) at the top of the back bands 36b. The ⅜ inch elastic is turned and coverstitched with the labels at the center of the back. The strap portions of bands 36a above the ⅜ inch elastic are turned and sewn on top of a 1½ inch elastic strip. A folder could be used if desired. The ends of the back and front straps 38 are overlocked. Next, bar tack the intersection of the Y and the labels. Loops 41 are sewn at the ends of the back Y. Finally, loops 41 are sewn on the front bands.

It is to be understood that the manufacturing techniques described above may also be adapted for making aerobic exercise suits of different configurations than those specifically illustrated herein.

Tests were conducted on the two piece suit 100 to compare the metabolic changes that occur during treadmill walking while wearing the suit in comparison to standard exercise apparel. The following are the test results:

Subject Selection

A well-conditioned 56-year-old professional male subject (maximum oxygen consumption=47 ml $kg^{-1}$ $min^{-1}$, height=69", weight=168 lbs) with over 160 treadmill test experiences served as the subject for this investigation. To accurately test the garment 100, it was necessary to have a subject who knew how to precisely duplicate the arm and leg mechanics for both the control conditions (NPGS=No Power Garment Suit 100) and the experimental Power Garment Suit 100 conditions (PGS) during each submaximal treadmill test. It was critical to have a reliable test conducted each time to reduce test-to-test variability under the control as well as the experimental suit 100 conditions.

Test Protocol and Parameters Monitored

A modified McHentry treadmill protocol was used. In this study the speed remained constant at 3.6 mph, and three Stages for 9 minutes at a 0% grade, then 3 minutes at 3% and then 3 minutes at 6% grade were used. The typical surfaces upon which people walk range between 0% to 6%.

A single-lead telemetry ECG was used to monitor exercise heart rates, and a MedGraphics 2000 gas analysis system was used to measure the metabolic oxygen cost of the exercise throughout each test. The sustained 9-min workload at 3.5 mph/0% grade was used to reflect the recommended speed used during fitness walking programs. The two additional percent grades are commonly encountered by fitness walkers within the confines of their local neighborhoods.

Oxygen consumption represents the amount of oxygen in milliliters per kilogram (2.2 lbs) of body weight (ml $kg^{-1}$ $min^{-1}$) required by the human body to conduct its metabolic activity during various levels of muscular effort. Energy producing organelles (mitochondria) in skeletal muscle tissue increase their oxygen requirements to reduce sugar and fat to a usable energy source called ATP (adenosinetriphosphate) as the muscles are increasingly stressed. By assessing the oxygen requirements of the body at any given moment, it is possible to evaluate the effects of the suit 100 on the muscular efforts of the body, and more importantly, the metabolic cost of exercising in the suit 100.

Results of the Investigation

In this investigation, the suit 100 used during treadmill walking at 3.5 mph/0.% grade produced a 33.37% greater metabolic response than did the standard exercise apparel (control garments) which included a cotton T-shirt, sneakers, socks and tennis shorts. The average oxygen consumption value of 21.74 ml $kg^{-1}$ $min^{-1}$ during the suit 100 use at 3.5 mph/0% grade in this investigation was greater than the values reported in the following published studies in which subjects carried varying sizes of hand-held weights (HHWs).

Zarandona et al (*Physician and Sports Medicine, b 14*(10): 113–120, October 1986) tested 30 trained men who carried either no HHWs, 1-lb weights, or 5-lb weights in both hands while treadmill walking at 3.5 mph/0% grade. They reported statistically significant values of 15.05 and 19.00 ml $kg^{-1}$ $min^{-1}$ while using 1-lb and 5-lb HHWs respectively. Other authors have also reported statistically significant increase in metabolic cost when their subjects were using 1-lb and 3-lb HHWs. See *Medicine and Science in Sports and Exercise,* 19(3): 260–265, June 1987 and *Research Quarterly,* 63(4): 435–437, December 1992.

Table 1 reports the oxygen consumption cost of walking at 3.5 mph/0% grade while wearing the suit 100.

Table 1 $VO^2$ ml $k^{-1}$ difference and % increase for NPGS* and PGS** conditions during 3.5 mph/0% grade treadmill walking

| NPGS | PGS | Difference | %increase |
|---|---|---|---|
| 16.30 | 21.74 | 5.44 | 33.37 |

* NPGS=no power garment suit

PGS=power garment suit 100**

Conclusions

1. The suit 100 produced a 33.37% greater increase in the metabolic cost of walking at 3.5 mph/0% grade than standard aerobic exercise apparel (cotton T-shirt, socks, sneakers, and tennis shorts).
2. In comparison to published hand-held weight studies, walking at 3.5 mph/0% grade while wearing the suit 100 produces a metabolic cost in oxygen consumed per minute that is 14.42% greater than when carrying two 5-lb hand-held weights while walking at the same speed and grade.
3. The built-in resistance bands of the suit 100 eliminate the need for carrying hand-held weights that involve isometric gripping which is known to cause elevated blood pressures.

Figure 7:
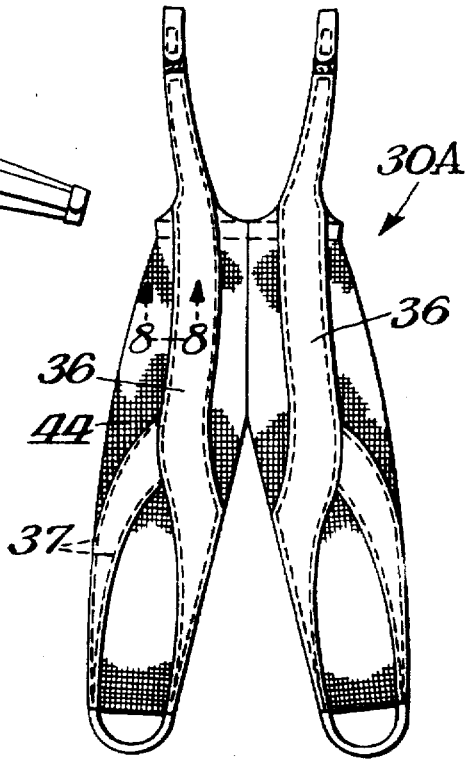
FIG. 7 is a front elevational view of a modified aerobic exercise garment in accordance with this invention.
Figure 8:
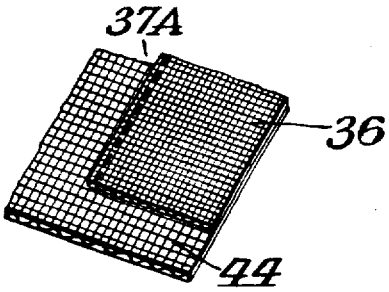
FIG. 8 is a cross-sectional view taken through FIG. 7 along the line 8—8.

The invention has been particularly described with respect to FIGS. 1–6 wherein the elastic resistance bands form panels which separate and are joined to base fabric material. The invention may also be practiced where the base fabric material in itself is a complete garment such as a shirt, pants, etc. and the elastic resistance bands are sewn on top of or below the base fabric. FIGS. 7–8, for example, illustrate a pants 30A of generally the same structure as pants 30 except that the elastic bands 36 are formed directly over the base fabric. This is shown, for example, in FIG. 8 where the elastic band material 36 is superimposed over (or below if desired) the fabric 44 and secured thereto by stitching 37A.

It is also to be understood that the invention may be practiced with forms of garments other than specifically described herein. For example, the pants may be short pants, particularly adapted for warm weather or indoor use and the base fabric may be made of a mesh material. A further variation would be to form the pants portion as a wrestler's suit which in turn incorporates the elastic bands in the manner herein described.

What is claimed is:

1. A method of making an aerobic resistance garment which includes a body portion and limb portions comprising the steps of providing a base material and a plurality of elastic resistance bands which are secured together to form the body portion and limb portions, each of the elastic resistance bands having a pair of longitudinal side edges and a pair of opposite ends intermediate the side edges, each of the elastic resistance bands being made of a material which has a direction of stretch for causing the user to exert a force in stretching the elastic resistance band and in resisting the elastic resistance band returning to its unstretched condition, anchoring each of the ends of the elastic resistance bands, and securing the elastic resistance band to the base material by attaching the longitudinal side edges of each elastic resistance band to the base material in a manner that the base material and elastic resistance band are free of attachment to each other between the longitudinal side edges and between the opposite ends of the elastic resistance band to minimize interference with the movement of the elastic resistance band along its direction of stretch.

2. The method of claim 1 wherein the garment includes a shirt portion having arms, and securing a first elastic resistance band to the shirt portion across the body portion and completely from one arm to the other with the first elastic resistance band being made of a single piece of material, and securing each end of the elastic resistance band to a loop outwardly of its arm to anchor the elastic resistance band.

3. The method of claim 2 including securing second and third elastic resistance bands to the side of the shirt portion opposite the first elastic resistance band, disposing adjacent ends of the second and third elastic resistance band against each other so that the second and third elastic resistance bands extend completely from one arm to the other, and joining the adjacent ends of the ends of the second and third elastic resistance bands by a zipper at the body portion.

4. The method of claim 2 wherein the aerobic resistance garment further includes a pants portion having a body section and legs, and securing further elastic resistance bands to the pants portion.

5. The method of claim 4 wherein the further elastic resistance bands on the pants portion include a first set of front elastic resistance bands and a second set of rear elastic resistance bands, and securing the further elastic resistance bands to the base material.

6. A method of making an aerobic resistance garment which includes a body portion and limb portions comprising the steps of providing a base material and a plurality of elastic resistance bands which are secured together to form the body portion and limb portions, each of the elastic resistance bands having a pair of longitudinal side edges and a pair of opposite ends intermediate the side edges, each of the elastic resistance bands being made of a material which has a direction of stretch for causing the user to exert a force in stretching the elastic resistance band and in resisting the elastic resistance band returning to its unstretched condition, securing each elastic resistance band to the base material by securing the elastic resistance band material to the base material at locations which minimize interference with the movement of the elastic resistance band along its direction of stretch, the garment including a shirt portion having arms, and securing a first elastic resistance band to the shirt portion across the body portion and completely from one arm to the other with the first elastic resistance band being made of a single piece of material, securing each end of the elastic resistance band to a loop outwardly of its arm, the aerobic resistance garment further including a pants portion having a body section and legs, securing further elastic resistance bands to the pants portion, the further elastic resistance bands on the pants portion include a first set of front elastic resistance bands and a second set of rear elastic resistance bands, securing the further elastic resistance bands to the base fabric, securing the set of front resistive elastic bands to the pants portion by providing one of the front elastic resistance bands for each of the legs, extending each of the front elastic resistance bands from above the body section down the body section to a location generally at a knee section and then diverting to extend completely down the remainder of the leg and beyond the leg and then to form a loop and then up the leg where it is secured to itself at the general location of the knee section.

7. The method of claim 6 wherein the rear set of elastic resistance bands includes an elastics resistance band for each of the legs, extending each of the rear elastic resistance bands from above the body portion down the body portion and down the legs to the general area of the legs where it is bifurcated and secured to the front elastic resistance bands.

8. The method of claim 7 including the front and rear elastic resistance bands together by adjustable connecting structure beyond the top of the body section to form adjustable suspenders, and connecting the rear elastic resistance bands to each other along a line from a location above the crotch to the adjustable suspenders.

9. The method of claim 1 including securing the elastic resistance bands between and to separate spaced portions of the base. material.

10. The method of claim 1 including securing the elastic resistance bands superimposed over and to the base material.

11. The method of claim 1 wherein the aerobic resistance garment includes a pants portion having a body section and legs, and securing the elastic resistance bands to the body section and legs.

12. A method of making an aerobic resistance garment which includes a body portion and limb portions comprising the steps of providing a base material and a plurality of elastic resistance bands which are secured together to form the body portion and limb portions, each of the elastic resistance bands having a pair of longitudinal side edges and a pair of opposite ends intermediate the side edges, each of the elastic resistance bands being made of a material which has a direction of stretch for causing the user to exert a force in stretching the elastic resistance band and in resisting the elastic resistance band returning to its unstretched condition, securing each elastic resistance band to the base material by securing the elastic resistance band material to the base material at locations which minimize interference with the movement of the elastic resistance band along its direction of stretch, the aerobic resistance garment including a pants portion having a body section and legs, securing the elastic resistance bands to the body section and legs, the elastic resistance bands on the pants portion including a first set of front elastic resistance bands and a second set of rear elastic resistance bands, securing the set of front elastic resistance bands to the pants portion by providing one of the front elastic resistance bands for each of the legs, extending each of the front elastic resistance bands from above the body section down the body section to a location generally at a knee section and then diverting to extend completely down the remainder of the leg and beyond the leg and then to form a loop and then up the leg where it is secured to itself at the general location of the knee section.

13. The method of claim 12 wherein the rear set of elastic resistance bands includes an elastic resistance band for each of the legs, extending each of the rear elastic resistance bands from above the body portion down the body portion and down the legs to the general area of the legs where it is bifurcated and secured to the front elastic resistance bands.

14. The method of claim 13 securing the set of rear elastic resistance bands of said pants portion to itself from a location above the crotch to a location above said body portion and then diverging the rear elastic resistance bands to form a Y, securing the front elastic resistance bands and the rear elastic resistance bands of the pants portion together beyond said body portion to form suspenders.

15. The method of claim 14 including securing a top end of each of the front and rear elastic resistance bands to loop members to render the suspenders adjustable.

16. The method of claim 12 including securing the elastic bands to and between separate spaced pieces of the base material.

17. The method of claim 12 including securing the elastic bands superimposed over the base material.

18. A method of making an aerobic resistance garment which includes a shirt portion having outwardly extending arms comprising the steps of providing a base material and a plurality of elastic resistance bands which are secured together to form the shirt portion into a leotard with the leotard including a neck portion and an oppositely located crotch portion, each of the elastic resistance bands having a pair of longitudinal side edges and a pair of opposite ends intermediate the side edges, each of the elastic resistance bands being made of a material which has a direction of stretch for causing the user to exert a force in stretching the elastic resistance band and in resisting the elastic resistance band returning to its unstretched condition, and securing each elastic resistance band to the base material by securing the elastic resistance band to the base material at locations which minimize interference with the movement of the elastic resistance band along its direction of stretch.

19. The method of claim 18 wherein the leotard has a front and a rear, the elastic resistance bands including a first elastic resistance band and second and third elastic resistance bands attaching the first elastic resistance band from arm to arm and across the front, attaching the second elastic resistance band from one arm to the rear, and attaching the third elastic resistance band from the other arm to the rear juxtaposed the second elastic resistance band.

20. The method of claim 19 including securing an end of each of the first and second and third elastic resistance bands to a loop at the end of each arm.

21. The method of claim 19 wherein the garment further includes a pants having legs with a front and a rear and a top, including mounting a front set of elastic resistance bands on the front of the pants extending from the top of the pants down each leg, and mounting a rear set of elastic resistance bands on the rear of the pants extending downwardly from the top of the pants to the legs.

22. The garment of claim 21 including securing the rear set of elastic resistance bands of the pants to itself from a location above the crotch and then diverging the set of rear elastic resistance bands to form a Y, and securing the front set of elastic resistance bands to the rear set of elastic resistance bands together to form suspenders.

23. A method of making an aerobic resistance garment which includes a pants having a body portion and legs extending downwardly from the body portion with the pants having a front and a rear and a top comprising the steps of providing a base material and a plurality of elastic resistance bands which are secured together to form the body portion and the legs, each of the elastic resistance bands having a pair of longitudinal side edges and a pair of opposite ends intermediate the side edges, each of the elastic resistance bands being made of a material which has a direction of stretch for causing the user to exert a force in stretching the elastic resistance band and in resisting the elastic resistance band returning to its unstretched condition, securing the elastic resistance bands to the base material along locations which minimize any interference with the movement of the elastic resistance bands along the direction of stretch, the elastic resistance bands including a front set of elastic resistance bands and a rear set of elastic resistance bands, extending the front set of elastic resistance bands on the front of the pants from the top of the pants down the legs, extending the rear set of elastic resistance bands from the rear of the pants downwardly to the legs, securing the rear set of elastic resistance bands to itself from a location above the crotch and then diverging the rear set of elastic resistance bands to form a Y, and securing the front and rear sets of elastic resistance bands together to form suspenders.

* * * * *

UNITED STATES PATENT AND TRADEMARK OFFICE

Certificate

Patent No. 5,737,772 Patented: April 14, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Timothy P. Dicker; William T. Wilkinson; and Susannah N. Archinal.

Signed and Sealed this Twenty-First Day of March, 2000.

JOHN C. CALVERT
Supervisory Patent Examiner,
Art Unit 3741